US010849403B2

(12) United States Patent
Lee

(10) Patent No.: US 10,849,403 B2
(45) Date of Patent: Dec. 1, 2020

(54) LIP GLOSS CONTAINER

(71) Applicant: SAMHWA CO., LTD., Uiwang-si (KR)

(72) Inventor: Kyung Chang Lee, Uiwang-si (KR)

(73) Assignee: SAMHWA CO., LTD., Uiwang-si (KR)

( * ) Notice: Subject to any disclaimer, the term of this patent is extended or adjusted under 35 U.S.C. 154(b) by 0 days.

(21) Appl. No.: 16/466,935

(22) PCT Filed: Jul. 20, 2017

(86) PCT No.: PCT/KR2017/007810
§ 371 (c)(1),
(2) Date: Jun. 5, 2019

(87) PCT Pub. No.: WO2018/105843
PCT Pub. Date: Jun. 14, 2018

(65) Prior Publication Data

US 2019/0307229 A1 Oct. 10, 2019

(30) Foreign Application Priority Data

Dec. 6, 2016 (KR) ..... 10-2016-0164999

(51) Int. Cl.
*A45D 34/04* (2006.01)
*B65D 51/32* (2006.01)
(Continued)

(52) U.S. Cl.
CPC ..... *A45D 34/046* (2013.01); *A45D 34/04* (2013.01); *A45D 34/043* (2013.01); *A45D 40/26* (2013.01);
(Continued)

(58) Field of Classification Search
CPC ..... A45D 34/045; A45D 34/046; A45D 2200/056
See application file for complete search history.

(56) References Cited

U.S. PATENT DOCUMENTS 2,691,184 A * 10/1954 Miller ..... A45D 40/24 401/129
4,189,245 A * 2/1980 Bennett ..... A45D 34/045 401/126
(Continued)

FOREIGN PATENT DOCUMENTS

JP 2013-066567 A 4/2013
KR 20-0436957 Y1 10/2007
(Continued)

*Primary Examiner* — David P Angwin
*Assistant Examiner* — Bradley S Oliver
(74) *Attorney, Agent, or Firm* — Novick, Kim & Lee, PLLC; Jae Yeon Kim

(57) ABSTRACT

A lip gloss container, having: a cap of a cylindrical member, to a lower center of which a brush rod is fitted and at a lower inner circumference thereof a female screw is formed; a lower container of a cylindrical member, the upper portion of which is open and the bottom portion thereof is closed to contain cosmetic contents; a cylindrical tube having opened top and bottom portions, which is inserted through the upper opening of the lower container; and a shoulder member provided with a male screw which is coupled to the upper outer circumference of the cylindrical tube so as to be coupled with a female screw of the cap at the upper outer circumference. The container has such an effect that cosmetic contents introduced into a brush rod receiving member and cosmetic contents in the lower container are not mixed with each other so that cosmetics in the container are not contaminated by cosmetics in use.

5 Claims, 5 Drawing Sheets

(51) Int. Cl.

| | |
|---|---|
| ***A45D 34/00*** | (2006.01) |
| ***A45D 40/26*** | (2006.01) |
| ***B65D 25/02*** | (2006.01) |
| *A45D 40/00* | (2006.01) |

(52) U.S. Cl.
CPC ..... *B65D 25/02* (2013.01); *B65D 51/32* (2013.01); *A45D 2034/002* (2013.01); *A45D 2040/0006* (2013.01)

(56) References Cited

U.S. PATENT DOCUMENTS

| | | | | | |
|---|---|---|---|---|---|
| 4,841,996 | A * | 6/1989 | Gueret | A45D 34/04 | 132/320 |
| 5,054,946 | A * | 10/1991 | Morel | A45D 34/046 | 401/122 |
| 5,332,325 | A * | 7/1994 | Crosnier | A45D 34/043 | 401/119 |
| 7,448,393 | B2 * | 11/2008 | Beak | A45D 34/045 | 132/218 |
| 7,607,441 | B2 * | 10/2009 | Hrymoc | A45D 33/003 | 132/218 |
| 7,824,121 | B2 * | 11/2010 | Ramet | A45D 34/046 | 401/122 |
| 8,668,401 | B2 * | 3/2014 | Francavilla | A45D 40/265 | 401/188 R |
| 9,060,587 | B2 * | 6/2015 | Pschirer | A45D 40/262 | |
| 9,427,064 | B2 * | 8/2016 | Kim | A45D 34/04 | |
| 9,801,449 | B2 * | 10/2017 | Lequeux | A45D 40/265 | |
| 10,010,152 | B2 * | 7/2018 | Chan | A45D 40/267 | |
| 10,130,157 | B2 * | 11/2018 | Fogueteiro | A45D 40/10 | |
| 2007/0158372 | A1 * | 7/2007 | Kurek | A45D 40/265 | 222/612 |
| 2008/0056807 | A1 * | 3/2008 | Vintimiglia | A45D 40/262 | 401/277 |
| 2008/0112752 | A1 * | 5/2008 | Zhang | A45D 34/042 | 401/174 |
| 2009/0016805 | A1 * | 1/2009 | Byun | B65D 83/0016 | 401/277 |
| 2009/0020551 | A1 * | 1/2009 | Malvar | A45D 40/265 | 401/132 |
| 2012/0132222 | A1 * | 5/2012 | Gueret | A45D 34/046 | 132/200 |
| 2013/0129399 | A1 * | 5/2013 | Limongi | A45D 34/045 | 401/16 |
| 2019/0029401 | A1 * | 1/2019 | Kim | A45D 34/00 | |

FOREIGN PATENT DOCUMENTS

| | | | |
|---|---|---|---|
| KR | 10-0819764 | B1 | 4/2008 |
| KR | 10-2012-0059893 | A | 6/2012 |
| KR | 10-2016-0084718 | A | 7/2016 |

* cited by examiner

LIP GLOSS CONTAINER

TECHNICAL FIELD

The present invention relates a lip gloss container, and more particularly, to a lip gloss container that prevent the cosmetic in the container from being contaminated by deploying the cosmetic stained on an application tip of a lip gloss in use and the cosmetic in the container in a space separated from each other.

BACKGROUND ART

In general, women use a lip gloss or a lipstick to protect their lips or express their lips healthily and beautifully.

The lip gloss and the lipstick are cosmetic products commonly used to make the lips beautiful. The lipstick is a cosmetic product that is mainly used when the lips are to be produced in various colors although it serves to maintain the moisture by being applied to the lips. However, the lip gloss aims to prevent drying of the lips and maintain the moisture rather than to produce the lips in various colors, and thus it is used by various people regardless of age and sex.

The lip gloss of the above-described cosmetic products, that is aiming to use for maintaining the moisture of lips, is used in different ways depending on the type of container manufactured and sold.

That is, a solid lip gloss in a shape of lipstick is adapted to be used by protruding a bar-shaped lip gloss from the container, a viscous lip gloss is housed in a tube-tube container to be applied on the lips while squeezing the container in a state in which an application tip provided on a front end of the tube-type container is in close contact with the lips, and a liquid lip gloss is housed in a container to be applied on the lips by applying the lip gloss to an application tip installed by means of a brush rod in a lid.

The lip gloss container, which is well known as a typical configuration, includes a container, a lid which is detachably attached to the opening of the container by a screw coupling, a brush rod having an application tip integrally formed in the lid, and a wiper which is installed over a upper edge of the container, blocks oil components of the lip gloss contained in the container from evaporating, and sweeps the lip stick to be a proper amount when pulling out an application tip stained with the lip gloss.

In such a conventional lip gloss container structure in the prior art, there have been problems in that when taking a brush rod out of inside the lip gloss container in order to apply cosmetics stained on an application tip on the lips and inserting it thereto, gel-type cosmetics are stained around an opening of the container and exposed to the outside thereof and thus are contaminated in the air, and since cosmetics in the container are placed in the same space as cosmetics stained on an application tip of the lip gloss in use, contaminated cosmetics of the lip gloss in use contaminate the cosmetics in the container.

DISCLOSURE

Technical Problem

The present invention is devised to meet the above-described needs of the prior art, and it is an object of the present invention to provide a cosmetic product container which allows cosmetics stained on an application tip of the lip gloss in use and cosmetics in a container to be placed in the space separated from each other, thereby preventing cosmetics in the container being contaminated by cosmetics in use.

Technical Solution

The lip gloss container according to a first embodiment of the present invention includes: a cap 10 of a cylindrical member, to a lower center of which a brush rod 11 is fitted and at a lower inner circumference thereof a female screw 12 is formed; a lower container 20 of a cylindrical member, the upper portion of which is open and the bottom portion thereof is closed to contain cosmetic contents; a cylindrical tube 30 having opened top and bottom portions, which is inserted through the upper opening of the lower container 20; a shoulder member 40 provided with a male screw 41 which is coupled to the upper outer circumference of the cylindrical tube 30 so as to be coupled with a female screw of the cap 10 at the upper outer circumference, an expanded tube portion 42 which is expanded and formed with a larger diameter at a lower portion of the male screw 41 to be coupled to the upper outer circumference of the lower container 20, a circumferential valve 43 which is fitted to the outer circumference of the cylindrical tube 30 and descends to move the cosmetic contents in the lower container 20 to the lower portion when the cosmetic contents in the lower container 20 are introduced into the cylindrical tube 30; and a brush rod receiving member 60 which is a cylindrical member with opened upper and lower portions and is vertically movable upward and downward in the inner circumference of the cylindrical tube 30, on the lower surface of which a fitting portion 61 to which a valve body 50 is fitted is formed, and a wiper member 62 is inserted into the upper inner portion thereof.

The valve body 50 includes: a flange member 51 which is fitted to the fitting portion (61) of the brush rod receiving member (60) to form a through hole 51*a* at a center, around which a flange 51*b* is formed so as to compress a spring 52 of the lower portion, and a piston fitting portion 51*c* into which a flange 51*b* is formed so as to compress a spring 52 of the lower portion, and a piston fitting portion 51*c* into which a piston 53 is fitted protrudes to the lower portion; a cylinder 56 which is fitted to the lower portion of the spring lower end supporting member 54 so that a cylindrical valve 55 inserted into the outer periphery of the piston 53 is in close contact with the inner periphery thereof; and a ball-shaped check valve 57 which is inserted into the lower portion of the cylinder 56 to allow the cosmetic contents to flow into the cylinder 56 through a lower hole 56*a*.

At the outer circumferential lower end of the cylinder 56, a circumferential groove 56*b* is formed, into which a circumferential protrusion 31 protruding circumferentially at the inner circumferential lower end of the cylindrical tube 30 is inserted.

On the lower outer circumference of the piston 53, two holes 53*a* are horizontally formed to allow the cosmetic contents in the cylinder 56 to flow into a center hole (53*b*) of the piston 53. The lip gloss container according to the present invention further includes a circumferential valve 43 which is in contact with the upper outer circumference of the cylindrical tube 30 and the upper inner circumference of the lower container 20, and seals to prevent external air from flowing into the cosmetic contents in the lower container 20.

The brush rod 11 includes an application tip 11*a*, on the lower end of which stains and applies cosmetic contents; and a upper expanded portion 11*b*, an expanded portion of which is expanded-tube, which is formed to press the wiper member 62 and the brush rod receiving member 60.

Advantageous Effects

The lip gloss container according to the present invention allows cosmetic contents introduced into a brush rod receiving member 60 not to be mixed with cosmetic contents in a lower container 20, thereby preventing cosmetics in the container from being contaminated by cosmetics in use.

BEST MODE

Figure 1:
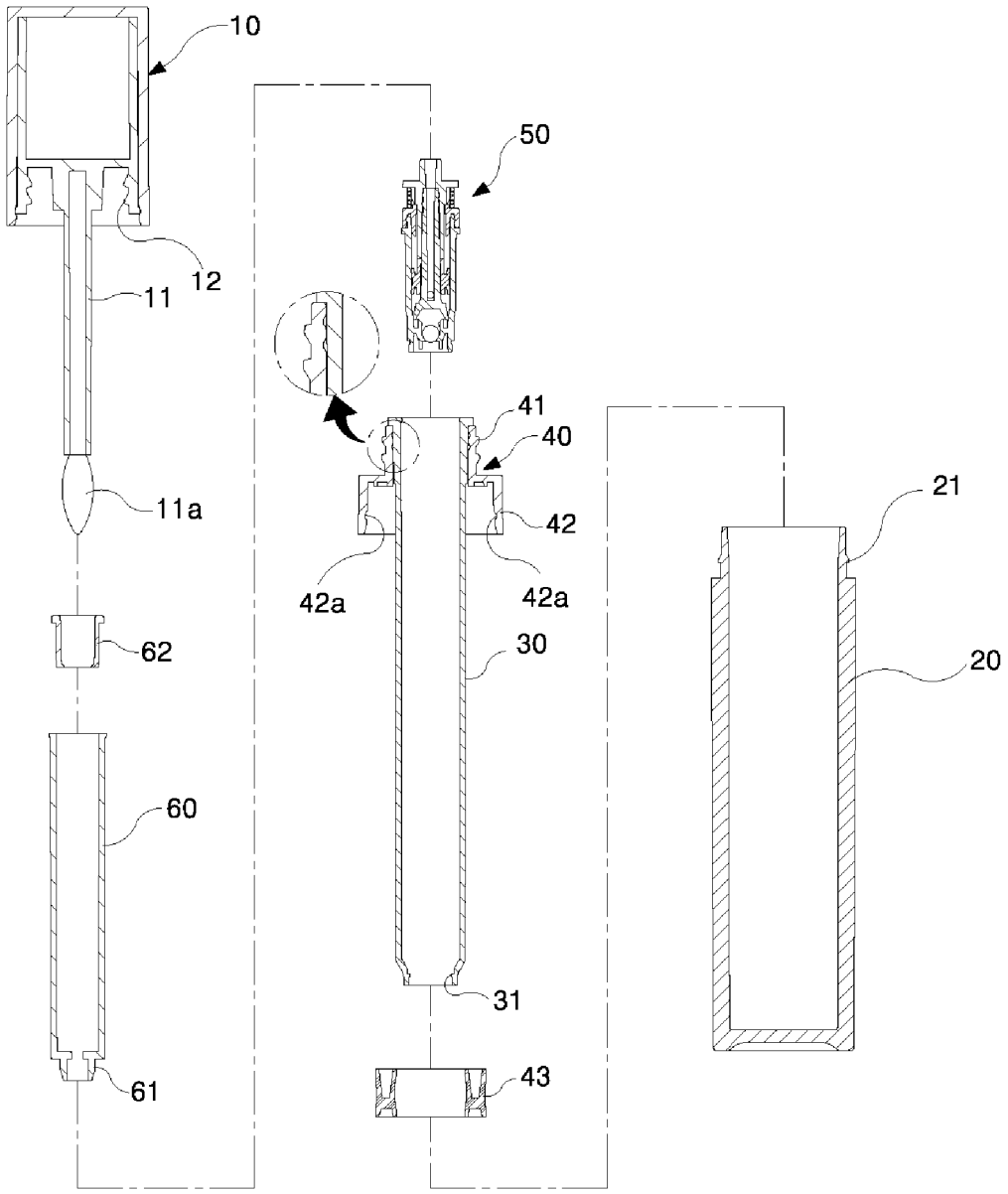
FIG. 1 is an exploded sectional view showing a lip gloss container of the present invention.

Hereinafter, preferred embodiments of the present invention will be described in detail with reference to the accompanying drawings so that these can easily be carried out by those skilled in the art. It should be noted that the reference numerals shown in the attached drawing are used to denote the same components even in other drawings whenever possible. In addition, in describing the present invention, the detailed description of known functions and configurations incorporated herein shall be omitted if it is deemed that it may unnecessarily obscure the gist of the present invention. Some features shown in the drawings are magnified, reduced, or simplified for ease of explanation, and the drawings and their components are not necessarily illustrated at an appropriate rate. However, those skilled in the art will easily understand these details.

It will be understood that the terms including ordinals such as "first," "second," etc. may be used herein to describe various components, but these components are not limited by these terms. These terms are only used to distinguish one component from another component. For example, without departing from the scope of the present invention, the first component may be referred to as a second component, and similarly, the second component may also be referred to as a first component. The term "and/or" includes any combination of a plurality of related listed items or any of a plurality of related listed items.

In addition, related terms described on the basis of what is shown in the drawings such as "front," "rear," "top," "below," and the like may be replaced with ordinals such as "first," "second," and the like.

The ordinal numbers such as "first," "second," and the like are arbitrarily set in the order described, and thus the order may be arbitrarily changed as necessary.

The terminology used herein is for the purpose of describing particular embodiments only and is not intended to be limiting of the invention. The singular forms comprise plural referents unless the context clearly dictates otherwise. It is to be understood that the terms such as "comprise" or "have" as described in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

Unless otherwise defined, all terms including technical and scientific terms used herein have the same meaning as commonly understood by those skilled in the art to which the present invention pertains. The terms defined in commonly used dictionaries should be interpreted as having a meaning that is consistent with their meaning in the context of the relevant arts, and will not be interpreted in an idealized or overly formal meaning unless expressly so defined herein. Hereinafter, preferred embodiments of the present invention will be described in detail with reference to the accompanying drawings. In addition, in describing the present invention, the detailed description of known functions and configurations incorporated herein will be omitted if it is deemed that it may unnecessarily obscure the gist of the present invention.

EMBODIMENT

Figure 2:
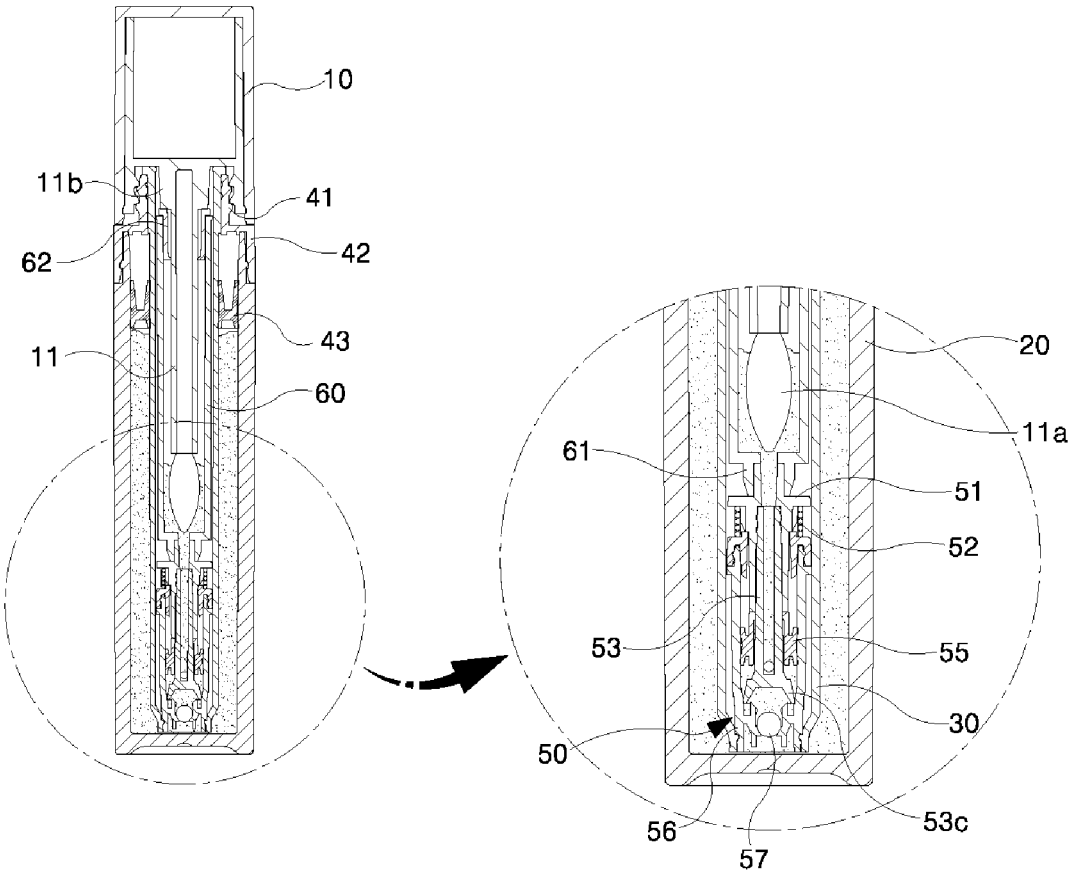
FIG. 2 is an assembled sectional view showing a state in which a cap of the lip gloss container of the present invention is closed.
Figure 3:
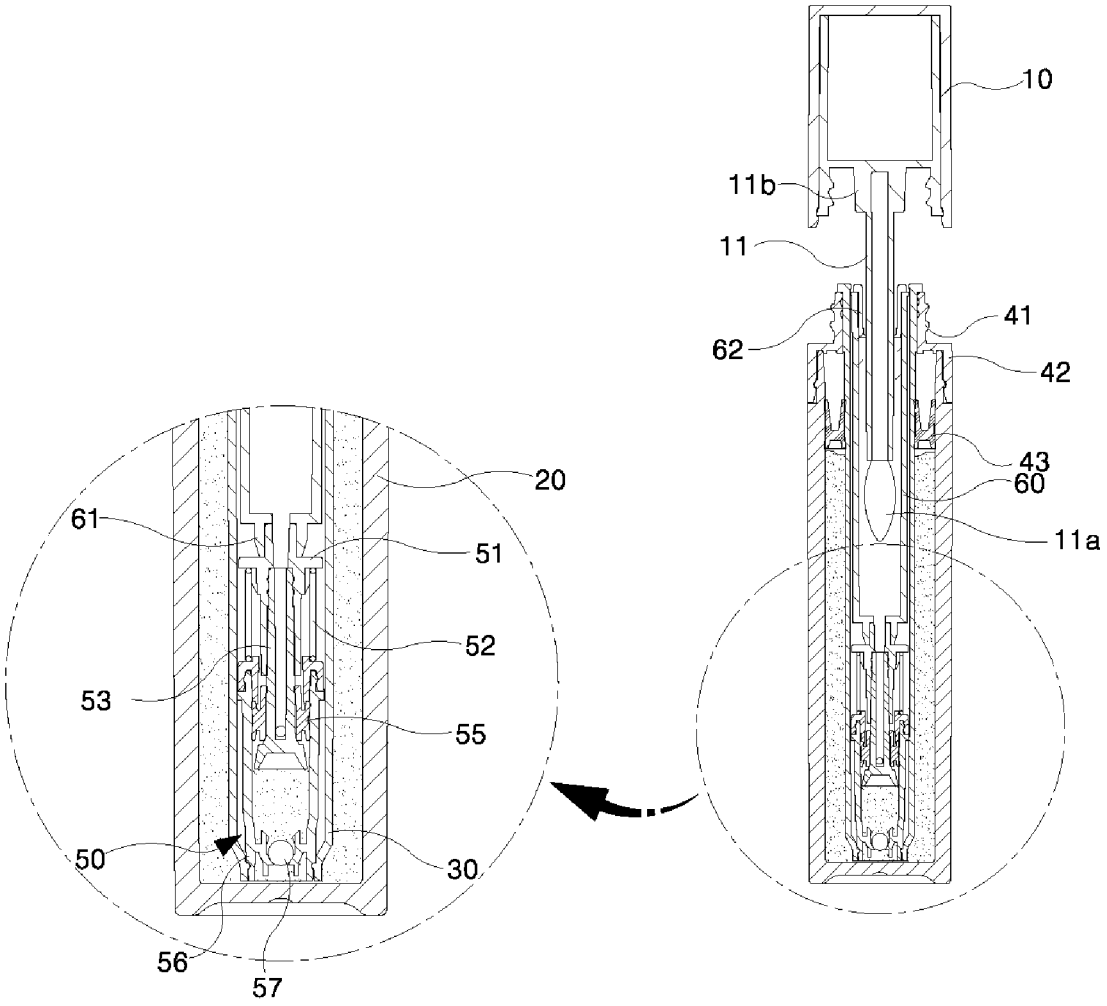
FIG. 3 is an assembled sectional view showing a state in which the cap of the lip gloss container of the present invention is open.
Figure 4:
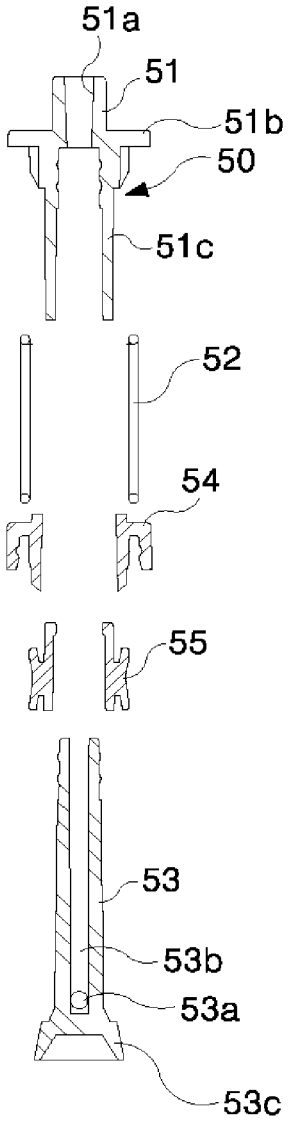
FIG. 4 is an exploded sectional view showing a valve for the lip gloss container of the present invention.
Figure 5:
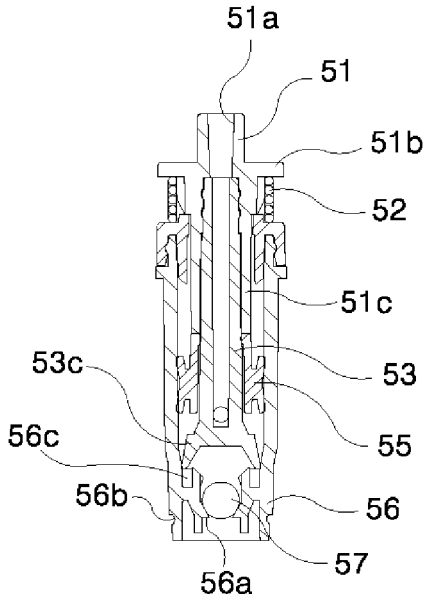
FIG. 5 is an assembled sectional view showing before the valve for the lip gloss container of the present invention is operated.
Figure 6:
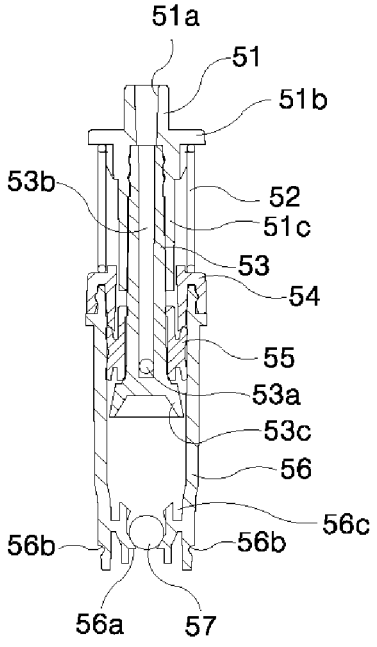
FIG. 6 is an assembled sectional view showing when the valve for the lip gloss container of the present invention is operated.

FIG. 1 is an exploded sectional view showing a lip gloss container of the present invention, FIG. 2 is an assembled sectional view showing a state in which a cap of the lip gloss container of the present invention is closed, FIG. 3 is an assembled sectional view showing a state in which the cap of the lip gloss container of the present invention is open, FIG. 4 is an exploded sectional view showing a valve for the lip gloss container of the present invention, FIG. 5 is an assembled sectional view showing before the valve for the lip gloss container of the present invention is operated, and FIG. 6 is an assembled sectional view showing when the valve for the lip gloss container of the present invention is operated.

As shown in FIGS. 1 to 6, the lip gloss container of the present invention may include: a cap 10 of a cylindrical member, to a lower center of which a brush rod 11 is fitted and at a lower inner circumference thereof a female screw 12 is formed; a lower container 20 of a cylindrical member, the upper portion of which is open and the bottom portion thereof is closed to contain cosmetic contents; a cylindrical tube 30 having opened top and bottom portions, which is inserted through the upper opening of the lower container 20; a shoulder member 40 provided with a male screw 41 which is coupled to the upper outer circumference of the cylindrical tube 30 so as to be coupled with a female screw of the cap 10 at the upper outer circumference, an expanded tube portion 42 which is expanded and formed with a larger diameter at a lower portion of the male screw 41 to be coupled to the upper outer circumference of the lower container 20, a circumferential valve 43 which is fitted to the outer circumference of the cylindrical tube 30 and descends to move the cosmetic contents in the lower container 20 to the lower portion when the cosmetic contents in the lower container 20 are introduced into the cylindrical tube 30; and a brush rod receiving member 60 which is a cylindrical member with opened upper and lower portions and is vertically movable upward and downward in the inner circumference of the cylindrical tube 30, on the lower surface of which a fitting portion 61 to which a valve body 50 is fitted is formed, and a wiper member 62 is inserted into the upper inner portion thereof.

The valve body 50 may include: a flange member 51 which is fitted to the fitting portion 61 of the brush rod receiving member 60 to form a through hole 51*a* at a center, around which a flange 51*b* is formed so as to compress a spring 52 of the lower portion, and a piston fitting portion 51*c* into which a piston 53 is fitted protrudes to the lower portion; a cylindrical spring lower end supporting member 54 which is in contact with the lower portion of the spring 52 so as to move vertically in the outer circumference of the piston fitting portion 51*c* of the flange member 51; a cylinder 56 which is fitted to the lower portion of the spring lower end supporting member 54 so that a cylindrical valve 55 inserted into the outer periphery of the piston 53 is in close contact with the inner periphery thereof; and a ball-shaped check valve 57 which is inserted into the lower portion of the cylinder 56 to allow the cosmetic contents to flow into the cylinder 56 through a lower hole 56*a*.

The protrusion formed at the inner circumference of the cylindrical tube 30 is inserted into the plurality of grooves formed at the upper inner wall of the shoulder member 40 and coupled firmly thereto.

Further, the protrusion 21 formed at an upper outer circumference of the lower container 20 is inserted into the groove 42*a* formed at an inner circumference of the expanded tube portion 42 and coupled firmly thereto.

Meanwhile, a circumferential groove 56*b* is formed at the outer circumferential lower end of the cylinder 56, into which a circumferential protrusion 31 protruding circumferentially at the inner circumferential lower end of the cylindrical tube 30 is inserted and coupled.

Further, two holes 53*a* are horizontally formed on the lower outer circumference of the piston 53 to allow the cosmetic contents in the cylinder 56 to flow into a center hole 53*b* of the piston 53, and a closed protrusion 53*c* of an expanded-tube formed at the lowermost end of the piston 53 is inserted into a groove 56*c* formed in the lower end of the cylinder 56 so as to prevent the cosmetic contents in the lower container 20 from flowing into the cylinder 56.

The reference number 11*a* (not described) indicates an application tip attached to a lower end of the brushing rod 11 and 11*b* indicates an upper expanded tube portion which is expanded-tube at an upper portion of the brush rod 11.

Next, the operation and effects of the lip gloss container according to the present invention will be described.

Firstly, referring to assembling the lip gloss container of the present invention, the cylindrical tube 30 and the shoulder member 40 are inserted through the upper opening portion of the lower container 20 to be coupled, the valve body 50 is inserted into the inner lower end of the cylindrical tube 30 to be pushed to the lower end, and then the circumferential protrusion 31 formed at a lower end inner circumference of the cylindrical tube 30 is inserted into the circumferential groove 56*b* formed at a lower end outer circumference of the cylinder 56 of the valve body 50.

The upper end of the flange member 51 of the valve body 50 is fitted into the fitting portion 61 of the brush rod receiving member 60 to be coupled thereto.

The application tip 11*a* and the brush rod 11 are inserted into the brush rod receiving member 60 together and the female screw 12 of the cap 10 is screw-coupled to the male screw 41 of the shoulder member 40.

The assembled state as described above is shown in FIG. 2(*a*).

In order to use the lip gloss container, as shown in FIG. 2(*b*), when a user opens the cap 10, the cap 10 is raised and the user paints his/her lip with the cosmetic contents stained at the application tip 11*a* of the brush rod 11 connected to the lower end of the cap 10.

The user closes the cap 10 after completing makeup, that is, when the female screw 12 of the cap 10 is screw-coupled to the male screw 41 of the shoulder member 40, the upper expanded-tube portion 11*b* of the brush rod 11 pushes the upper surface of the wiper member 62 and the brush rod receiving member 60 and then the brush rod receiving member 60 pushes the flange member 51 connected to the lower portion while it descends. At this time, the flange member 51 descends to press the spring 52 on the lower surface of the flange 51*b*, the piston 53 inserted into the piston fitting portion 51*c* descends first, and the lower surface of the piston fitting portion 51*c* pushes the cylindrical valve 55 inserted into the outer circumference of the piston 53 downwards and descends while being in close contact with the inner wall of the cylinder 56.

As the cylindrical valve 55 descends, the space inside the cylinder 56 is reduced and compressed, and thus the cosmetic contents in the lower container 20 flow into the cylinder 56 through the check valve 57. The cosmetic contents in the cylinder 56 flow into the central hole 53*b* through the hole 53*a* of the piston 53, flow into the through hole 51*a* at the center of the flange member 51, flow into the brush rod receiving member 60 with the application tip 11*a*, and are applied on the application tip 11*a*.

At the same time, as the piston 53 descends, the closed protrusion 53*c* at the lowermost end of the piston 53 is inserted the groove 56*c* formed in the lower circumference of the cylinder 56, and blocks the cosmetic contents from flowing in the lateral direction of the piston 53. That is, since the cosmetic contents in the lower container 20 are isolated from the cosmetic contents in the cylinder 56 so that the outside air is not introduced, the cosmetic contents in the lower container 20 are not contaminated.

When the cap 10 is opened to apply the lip gloss in this state, the spring 52 is decompressed, and as the flange member 51 and the piston 53 are lifted in the cylinder 56, the hole 53*a* is closed by the cylindrical valve 55.

As a result, the lip gloss container according to the present invention is configured so that the cosmetic contents introduced into the brush rod receiving member 60 are not mixed with the cosmetic contents in the lower container 20, thereby preventing the cosmetic contents in the container from being contaminated by cosmetics in use.

As described above, while the present invention has been described with respect to the specific embodiments, it will be apparent to those skilled in the art that various changes and modifications could be made without departing from the spirit and scope of the present invention as defined in the claims.

The invention claimed is:

1. A lip gloss container, comprising:

a cap of a cylindrical member, to a lower center of which a brush rod is fitted and at a lower inner circumference thereof a female screw is formed;

a lower container of a cylindrical member, an upper portion of which is open and a bottom portion thereof is closed to contain cosmetic contents;

a cylindrical tube having opened top and bottom portions, which is inserted through an upper opening of the lower container;

a shoulder member provided with a male screw which is coupled to an upper outer circumference of the cylindrical tube so as to be coupled with a female screw of the cap at an upper outer circumference, an expanded tube portion which is expanded and formed with a larger diameter at a lower portion of the male screw to be coupled to an upper outer circumference of the lower container, a circumferential valve which is fitted to the outer circumference of the cylindrical tube and descends to move the cosmetic contents in the lower container to a lower portion thereof when the cosmetic contents in the lower container are introduced into the cylindrical tube; and a brush rod receiving member which is a cylindrical member with opened upper and lower portions and is vertically movable upward and downward in an inner circumference of the cylindrical tube, on a lower surface of which a fitting portion to which a valve body is fitted is formed, and a wiper member is inserted into an upper inner portion thereof.

2. The lip gloss container according to claim 1, wherein the valve body comprises:

a flange member which is fitted to the fitting portion of the brush rod receiving member to form a through hole at a center, around which a flange is formed so as to compress a spring, and a piston fitting portion into which a piston is fitted protrudes;

a cylindrical spring lower end supporting member which is in contact with a lower portion of the spring so as to move vertically in an outer circumference of the piston fitting portion of the flange member;

a cylinder which is fitted to a lower portion of the spring lower end supporting member so that a cylindrical valve inserted into an outer periphery of the piston is in close contact with the inner periphery thereof; and a ball-shaped check valve which is inserted into the lower portion of the cylinder to allow the cosmetic contents to flow into the cylinder through a lower hole.

3. The lip gloss container according to claim 2, wherein a circumferential groove is formed at an outer circumferential lower end of the cylinder, into which a circumferential protrusion protruding circumferentially at an inner circumferential lower end of the cylindrical tube is inserted and coupled.

4. The lip gloss container according to claim 1, wherein two holes are horizontally formed on a lower outer circumference of the piston to allow the cosmetic contents in the cylinder to flow into a center hole of the piston, and a closed protrusion of an expanded-tube formed at the lowermost end of the piston is inserted into a groove formed in a lower end of the cylinder so as to prevent the cosmetic contents in a lower container from flowing into the cylinder.

5. The lip gloss container according to claim 1, wherein the brush rod comprises: an application tip on a lower end thereof which stains and applies the cosmetic contents; and an upper expanded portion, an upper portion of which is expanded-tube, which is formed to press the wiper member and the brush rod receiving member.

* * * * *